US006851592B1

(12) United States Patent
Owen et al.

(10) Patent No.: US 6,851,592 B1
(45) Date of Patent: Feb. 8, 2005

(54) SERRATED CUTTING STRIP

(75) Inventors: Edwin Wyn Owen, Tile Hill (GB); Ian Jamie, Leamington Spa (GB)

(73) Assignee: Carton Edge Systems Limited, Coventry (GB)

( * ) Notice: Subject to any disclaimer, the term of this patent is extended or adjusted under 35 U.S.C. 154(b) by 0 days.

(21) Appl. No.: 10/257,303

(22) PCT Filed: Feb. 29, 2000

(86) PCT No.: PCT/US00/05132

§ 371 (c)(1),
(2), (4) Date: Apr. 28, 2003

(87) PCT Pub. No.: WO01/64567

PCT Pub. Date: Sep. 7, 2001

(51) Int. Cl.[7] ..... B26F 3/00; B27B 33/02

(52) U.S. Cl. ..... 225/1; 225/91; 83/848

(58) Field of Search ..... 225/1, 48, 56, 225/49, 91; 453/86, 378; 83/697, 695, 848, 852, 846, 847, 849, 850, 853, 854; 30/355

(56) References Cited

U.S. PATENT DOCUMENTS

| | | | | | |
|---|---|---|---|---|---|
| 735,586 | A | * | 8/1903 | Rabie | 83/850 |
| 759,958 | A | * | 5/1904 | Batchelder | 83/849 |
| 1,915,736 | A | * | 6/1933 | Hurlbut | 225/19 |
| 3,929,050 | A | * | 12/1975 | Salzwedel | 83/848 |
| 4,506,816 | A | * | 3/1985 | Roccaforte | 225/48 |
| 5,078,311 | A | * | 1/1992 | Taguchi et al. | 225/43 |
| 5,328,071 | A | * | 7/1994 | Aihara | 225/91 |

FOREIGN PATENT DOCUMENTS

| | | | |
|---|---|---|---|
| DE | 8904789 | * | 9/1989 |
| EP | 603398 | * | 6/1994 |
| FR | 2576588 | * | 1/1986 |

* cited by examiner

*Primary Examiner*—Boyer D. Ashley
(74) *Attorney, Agent, or Firm*—Wood, Phillips, Katz, Clark & Mortimer

(57) ABSTRACT

The present invention provides a cutting strip (102) which includes a flat, strip member (201) adapted to be attached to the edge of a carton. The member (201) having a first edge (202) having a plurality of teeth (204). The plurality of teeth (204) having a non-uniform tooth pattern (205) which comprises a first tooth pattern along a first section (209) of the edge and a second tooth pattern (207) along a second section (210) of the edge so that a sheet-tearing force can be applied to a sheet on either the first end or the second end of the member (201).

11 Claims, 1 Drawing Sheet

SERRATED CUTTING STRIP

FIELD OF THE INVENTION

This invention relates to the field of cutting strips, and more specifically to serrated cutting strips for a carton edge.

Cartons which hold rolls of plastic wrap, foil, freezer paper, or wax paper and the like typically have cutting strips attached to their edges for cutting the plastic wrap, etc. after it is unrolled from the carton. Typically, the cutting strip is made from metal strip having a series of uniform teeth running along its upper edge. The wrap or foil is pulled out of the carton against the teeth and a section of it is cut or torn off.

Such a design can be improved. For instance, users often have a difficult time initiating and propagating a tear. Usually, the user has to get just the right angle to start the tear since the teeth uniformly point straight upwards. Moreover, if the user changes hands or wants to tear the sheet at the from the other end of the roll, they must re-maneuver to get the sheet at the correct angle relative to the teeth to initiate the tear.

Thus, what is needed is a cutting strip having an enhanced cutting function so that it is easier to initiate a tear and which provides for optimally tearing a sheet in either direction and from either end of the strip.

SUMMARY OF THE INVENTION

The present invention provides a cutting strip which includes a plurality of teeth. The plurality of teeth having a first tooth pattern along a first section of the cutting strip and a second tooth pattern along a second section of the cutting strip so that an enhanced sheet-tearing force can be applied to a sheet on either the first end or the second end of the cutting strip.

In one aspect, the present invention provides a carton which includes a holding section for holding a rolled sheet and a cutting strip attached to an edge of the holding section for cutting the rolled sheet into sections. The cutting strip comprising a plurality of teeth along an edge of the cutting strip, the plurality of teeth having a non-uniform tooth pattern so that an enhanced sheet-tearing force can be applied on either the first end or the second end of the cutting strip.

Advantageously, the present invention provides a cutting strip having a means for providing an enhanced cutting action applicable from either end of the strip.

DESCRIPTION OF PREFERRED EMBODIMENTS

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digits of reference numbers appearing in the Figures generally corresponds to the Figure number in which that component is first introduced, such that the same reference number is used throughout to refer to an identical component which appears in multiple Figures.

Figure 1:
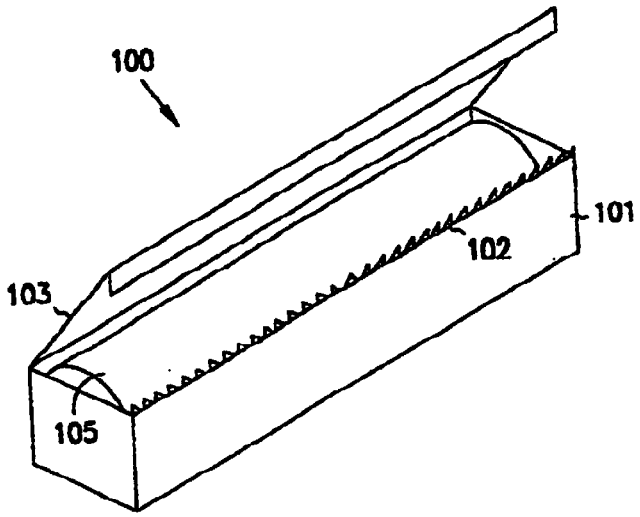
FIG.1 shows an isometric view of one embodiment of a carton having a cutting strip in accord with the present invention.

FIG. 1 shows an isometric view of one embodiment of a carton 100 in accord with the present invention. Carton 100 includes a holding section 101, a cutting strip 102, and a lid 103. Holding section 101 of carton 100 is a box portion of carton 100 for holding a rolled sheet 105. Rolled sheet 105 can include such material as plastic wrap, aluminum foil, freezer paper, or wax paper, and the like. In the exemplary embodiment, carton 100 is a generic box, typically made from a papeboard material which is cut and folded to form a box-shaped container. Alternatively, carton 100 can be made from any other desirable material, such as corrugated paper, plastic, laminated paperboard, and the like. Although the exemplary embodiment is a long, skinny carton, carton 100 can be almost any shape or size the scope of the present invention.

Cutting strip 102 is a serrated-edged blade member for cutting or tearing sections off of rolled sheet 105. In the exemplary embodiment, cutting strip 102 is made from a plastic material. One such material is disclosed in U.S. Pat. No. 5,866,221 to Owen, et al., titled IMPREGNATED AND SERRATED CUTTING STRIP FOR A CARTON, which is incorporated herein by reference.

Alternatively, it is made from paper, laminated paper, PET, PVC, HDPE, OPP, or metal laminates.

Cutting strip 102 is attached to an edge of carton 100 so that an edge of strip 102 is exposed over the edge of carton 100. In one embodiment, cutting strip 102 is attached to carton 100 using a pressure sensitive adhesive. Such a method is discussed in U.S. Pat. No. 5,866,221 to Owen, et al., cited above. Alternatively, as is known in the art, cutting strip 102 is applied to carton 100 by performing a metal strip so that extend downward below the perforation and then the strip is forced into carton 100 to fix cutting strip 102 thereon Alternatively, other attachment techniques, such as stapling, are possible.

Figure 2:
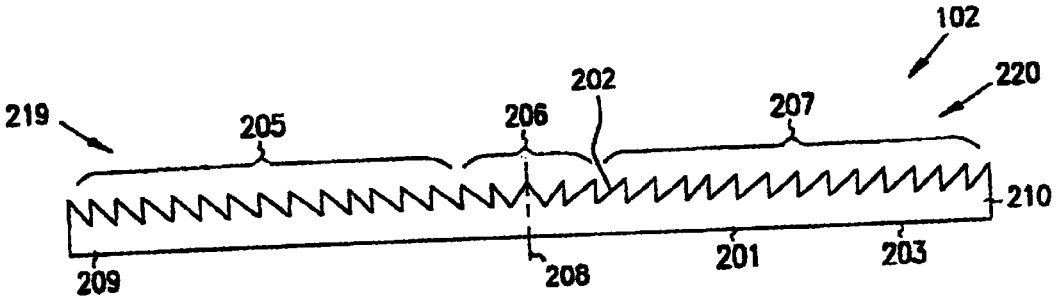
FIG. 2 shows a front view of the cutting strip of FIG. 1.

FIG. 2 shows a side view of the exemplary embodiment of cutting strip 102. Cutting strip 102 includes a main body member 201, a top edge 202, a bottom edge 203, and a plurality of teeth 204. Cutting strip 12 is generally a flat strip member having a series of notches cut or stamped into its top edge 202 which results in the plurality of teeth 204. Cutting strip 102 can have any length or thickness desirable depending on the length of roll 105 and carton 100.

Teeth 204 are sharp-pointed members for cutting, tearing, or detaching a section of a sheet. Teeth 204 have a non-uniform tooth pattern which allows a sheet-tearing force to be applied to a sheet on either end of cutting strip 102. In the exemplary embodiment, teeth 204 have a first tooth profile or pattern 205 along a first section 209 of edge 202 and a second tooth profile or pattern 207 along a second section 210 of edge 202. In first tooth pattern 205, each tooth 204 has a generally triangular-shaped profile and is pointed in an offset manner towards first section 209. This first tooth pattern 205 is designed to cut a sheet which is pulled or dragged along the edge in a first direction indicated by arrow 219. Since teeth 204 in first pattern 205 are angled or pointing towards the end second 209 of strip 102, they provide an optimal cutting edge to initiate a tear in a sheet from that end since they naturally provide the correct cutting angle to initiate the tear.

In second tooth pattern 207, each tooth 204 has generally triangular shape and is pointed or angled in an offset manner towards second section 210. This second tooth pattern 207 is designed to cut a sheet which is pulled or dragged along the edge in a second direction indicated by arrow 220. Since teeth 204 in second pattern 207 are angled or pointing towards the end section 210 of strip 102, they provide an optimal cutting edge to initiated a tear in a sheet from that end since they naturally provide the correct cutting angle to initiate a tear.

Since pattern 205 and 207 are non-uniform, a sheet can be torn from either end without having to adjust the sheet to initiate the cut. For example, a user can merely grab either end of a sheet and tear the sheet. Both patterns 205 and 207 provide enhanced cutting surfaces on their respective ends, and the non-uniformity of the patterns provide for optimal cutting from either end.

In one embodiment, each of teeth 204 have a constant thickness. Alternatively, the top portion of each tooth is compressed so that the tooth has a generally pyramid shape with sloping sides. Such a shape can increase the cutting power of the tooth and helps prevent dulling after repeated use.

In the exemplary embodiment, the plurality of teeth 204 have a generally symmetrical pattern relative to a mid-point 208 of cutting strip 102 (ie., first pattern 205 is a mirror image of second pattern 207). Teeth 204 include a transition tooth pattern 206 between patterns 205 and 207. Transition pattern 206 can be a small section or a large section of cutting strip 102. In alternative embodiment, the size or length of patterns 205, 206, and 207 can be varied according to design needs within the scope of the present invention.

Figure 3:
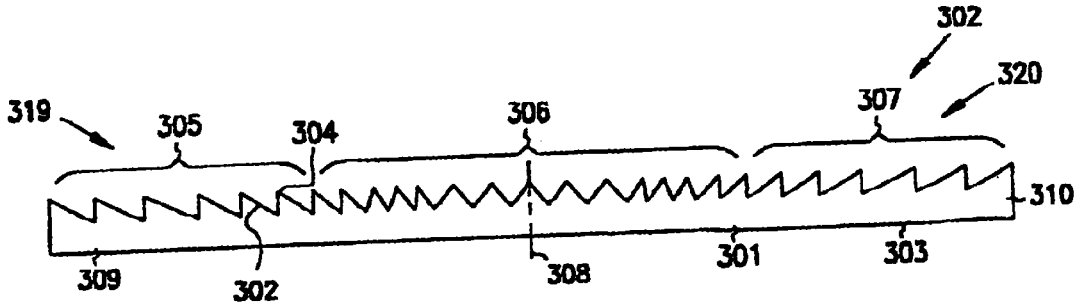
FIG. 3 shows a front view of another embodiment of a cutting strip in accord with The present invention.

FIG. 3 shows a side view of another embodiment of a cutting strip 302 in accord with the present invention. Cutting strip 302 is similar to strip 102 and will not be described in detail. Strip 302 includes a main body member 301, a top edge 302, a bottom edge 303, and a plurality of teeth 304 having a non-uniform pattern. In the exemplary embodiment of FIG. 3, the non-uniform tooth pattern gradually changes from a first tooth pattern 305 to a transition tooth pattern 306 to a second tooth pattern 307.

In first tooth pattern 305, each tooth 304 has a generally triangular shape and is pointed in an offset manner towards first section 309. As the teeth reach the middle section of strip 320 they gradually become more upright and less angled until they merge with transition tooth pattern 306. This first tooth pattern 304 is designed to cut a sheet in a first direction indicated by arrow 319. Since teeth 304 in first pattern 305 are angled or pointing towards the end section 309 of strip 302, they provide an optimal cutting edge to initiate a tear in a sheet from that end since they naturally provide the correct cutting angle to initiate the tear.

In second tooth pattern 307, each tooth 304 has a generally triangular shape and is pointed or angled in an offset manner towards second section 310. As the teeth reach the middle section of strip 320 they gradually become more upright and less angled and gradually merge with transition pattern 306. This second tooth pattern 307 is adapted to cut a sheet in a second direction indicated by arrow 320. Since teeth 304 in second pattern 307 are angled or pointing towards the end section 310 of strip 102, they provide an optimal cutting edge to initiated a tear in a sheet from that end since they naturally provide the correct cutting angle to initiate the tear.

Since patterns 305 and 307 are non-uniform, a sheet can be torn from either end without having to adjust the sheet to initiate the cut. For example, a user can merely grab either end of a sheet and tear the sheet. The patterns 305 and 307 provide an optimal cutting surface on their respective ends, and the non-uniformity of the patterns provide for optimal cutting from either end.

In the exemplary embodiment, the plurality of teeth 304 have a generally symmetrical pattern relative to a mid-point 308 of cutting strip 102 (ic, first pattern 305 is a mirror image of second pattern 307). Alternatively, the size or length of patterns 305, 306, and 307 can be varied according to design needs within the scope of the present invention.

Those skilled in the art will appreciate that other non-uniform tooth patterns are possible other than the exemplary dual tooth pattern of cutting strip 102 and the gradually changing tooth pattern of cutting strip 302. For instance, the tooth patterns of the embodiments shown can be combined in some manner, or the transition tooth pattern of either embodiment can be lengthened or shortened as desired, or the teeth on one side can have a different style than the teeth on the other side, and so on.

Conclusion

The present invention provides a cutting strip adapted to be attached to a carton. The cutting strip includes a plurality of teeth having a first tooth pattern along a first section of the strip and a second tooth pattern along a second section of the strip so tat a sheet-tearing force can be applied to a sheet on either the first end or the second end of the cutting strip.

Advantageously, the present invention provides an optimal means for initiating and propagating a tear from either end of a serrated cutting strip. The cutting strip having an enhanced cutting function so that it is easier to initiate a tear and having a non-uniform tooth pattern for optimally tearing a sheet in either direction and from either end of the strip.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A cutting strip, comprising:

a member having an edge comprising a first end section and a second end section, the edge having a plurality of teeth, wherein the teeth have a first tooth pattern along the first end section and the teeth have a second tooth pattern along the second end section, wherein in the first tooth pattern each tooth is angled outwards generally towards a first end of the member and in the second tooth pattern each tooth is angled outwards generally towards a second end of the member, the edge further comprising a middle section between the first and second end sections and a tooth pattern change section between the middle section and each of the first and second end sections, the teeth in the middle section and the tooth pattern change sections having different tooth patterns from the first and second tooth patterns, and the tooth pattern change sections include teeth at an angle between an angle of the teeth in the middle section and an angle of the teeth in an adjacent end section.

2. A cutting strip as claimed in claim 1, wherein the or each tooth in the middle section points straight upwards.

3. A cutting strip as claimed in claim 1, wherein the tooth pattern in the tooth pattern change sections is of a different pitch from the pitch of the tooth patterns in the end sections.

4. The cutting strip of claim 1, wherein the member is adapted to be attached to an edge of a carton.

5. The cutting strip of claim 1, wherein the member has a midpoint, and the plurality of teeth of the edge have a symmetrical pattern relative to the midpoint of the member.

6. The cutting strip of claim 1, wherein each of the plurality of teeth of the edge has a generally triangular-shaped profile.

7. The cutting strip of claim 1, wherein the strip member has an adhesive on a side thereof.

8. The cutting strip of claim 1, wherein the majority of the teeth of the edge are angled.

9. A carton comprising:

a holding section for holding a rolled sheet; and a cutting strip attached to an edge of the holding section for cutting the rolled sheet into sections;

wherein the cutting strip is the cutting strip of claim 1.

10. A method of tearing a sheet, the method comprising:

providing a cutting strip as claimed in claim 1; and pulling the sheet along the cutting strip from either the first section or the second section so that a tearing action is initiated.

11. A cutting strip comprising:

a member having an edge comprising a first end section and a second end section, the edge having a plurality of teeth, wherein the teeth have a first tooth pattern along the first end section and the teeth have a second tooth pattern along the second end section, wherein in the first tooth pattern each tooth is angled outwards generally towards a first end of the member and in the second tooth pattern each tooth is angled outwards generally towards a second end of the member, the edge further comprising a middle section between the first and second end sections and a tooth pattern change section between the middle section and each of the first and second end sections, the teeth in the middle section and the tooth pattern change sections having different tooth patterns from the first and second tooth patterns, wherein the pattern of teeth gradually changes from the first tooth pattern to the tooth pattern of the middle section through the first tooth pattern change section, and gradually changes from the tooth pattern of the middle section to the second tooth pattern through the second tooth pattern change section.

* * * * *